United States Patent [19]

Peraniitty et al.

[11] Patent Number: 5,074,055

[45] Date of Patent: Dec. 24, 1991

[54] APPARATUS FOR HEATING A DIELECTRIC WEB OR SHEET MATERIAL OR FOR DECREASING ITS MOISTURE CONTENT

[75] Inventors: Markku Peraniitty, Vantaa; Kauko Kotikangas, Helsinki, both of Finland

[73] Assignee: Imatran Voima Oy, Helsinki, Finland

[21] Appl. No.: 506,060

[22] Filed: Apr. 9, 1990

[30] Foreign Application Priority Data

Apr. 11, 1989 [FI] Finland ..... 891701

[51] Int. Cl.[5] ..... B10K 5/00

[52] U.S. Cl. ..... 34/1 E; 219/10.61 R; 219/10.61 A; 34/110

[58] Field of Search ..... 34/1, 17, 18, 60, 68, 34/4; 219/10.61 R, 10.61 A

[56] References Cited

U.S. PATENT DOCUMENTS

| | | | |
|---|---|---|---|
| 2,766,362 | 10/1956 | Kinder | 219/10.61 R X |
| 3,681,558 | 8/1972 | Grassman . | |
| 3,761,670 | 9/1973 | Slaats et al. | 34/1 X |
| 3,931,682 | 1/1976 | Candor | 34/1 |
| 4,773,166 | 9/1988 | Candor | 34/1 |
| 5,024,004 | 6/1991 | Jaeger | 34/1 |

FOREIGN PATENT DOCUMENTS

| | | |
|---|---|---|
| 1961208 | 6/1971 | Fed. Rep. of Germany . |
| 55922 | 5/1971 | Finland . |

*Primary Examiner*—Henry A. Bennet

*Attorney, Agent, or Firm*—Armstrong, Nikaido, Marmelstein, Kubovcik & Murray

[57] ABSTRACT

The invention concerns equipment for drying of a web material (1) or for equalization of its moisture content by means of induction heating. The web is passed between the rolls in two or more pairs of rolls (2,3; 4,5; 6,7). High-frequency energy is passed to one of the rolls (2,4,6) in the pairs of rolls by means of a capacitive energy transfer member. One of the electrodes in this capacitive energy transfer member consists of the mantle of the roll (2,4,6) concerned. As the other electrode, a trough unit (8,9,10) which surrounds a part of the roll mantle is arranged. Alternatively, the trough unit may be substituted for by a rod electrode, which may be placed outside or inside the roll.

13 Claims, 3 Drawing Sheets

Figure 1:
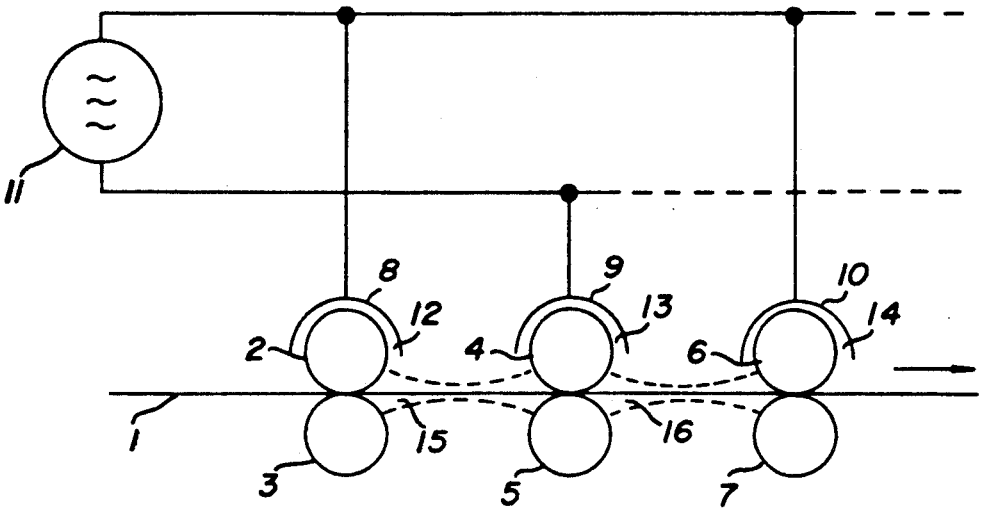

APPARATUS FOR HEATING A DIELECTRIC WEB OR SHEET MATERIAL OR FOR DECREASING ITS MOISTURE CONTENT

The invention concerns an apparatus or an equipment by means of which the temperature of a web or sheet dielectric material can be raised or its moisture content can be lowered by making use of high-frequency heating. Especially in the lowering of moisture content, high-frequency heating has proved advantageous in the respect that its drying effect is applied expressly to the portions of the material that have the highest moisture content. The result that is obtained is lowering of the average moisture content and equalization of the moisture distribution in the product to be dried. In particular in conventional drying of veneers for plywood, the providing of uniform ultimate moisture content has proved problematic owing to the high variation in the initial moisture in veneers.

Thus, the invention is meant, in the first place, for use in equipments for the drying of veneers for plywood, wherein the veneer to be dried is carried along a substantially horizontal track, which consists of nips formed by pairs of rolls placed one after the other. Between the rolls, the veneer is subjected to a flushing effect of a hot air flow. The function of the pairs of rolls is to carry the veneer, on one hand, but also to restrict bulging of the veneer during the drying, on the other hand. As further suitable objects of use should be mentioned hardening of fiberboard or heating of plastic materials for moulding. In the following, the invention will be described in relation to its application of veneer drying.

In veneer drying equipments, wherein the material web to be dried is in contact with rolls transverse to the direction of running of the web either directly or by the intermediate of a coating, it is known in prior art to pass high-frequency energy to at least some rolls. In such a case, the magnetic field between two rolls of opposite polarity is largely applied at the dielectric veneer placed between the rolls and produces heating and vaporization of the water contained in said veneer. In these equipments, it has been a problem how to transfer the energy to the revolving rolls, for in transfer members based on galvanic contact, sparking occurs, and the members are subject to contamination and wear.

An essential improvement in respect of said problem of transfer of energy is suggested in the German Published Patent Application No. 1,961,208, wherein the transfer of energy is effected capacitively. The capacitor that operates as the transfer member is accomplished as a plate or cylinder capacitor, in which the electrode connected to the source of current is stationary, whereas the counter-electrode revolves along with the roll. The axle which forms the core of the roll is connected to the counter-electrode.

In respect of its basic principle, said embodiment is sound, even though its embodiment of equipment involves deficiencies. The dimensions of a transfer capacitor placed at the end of a roll must be made substantially large in relation to the diameter of the roll in order to provide an adequate transfer capacity, which circumstance is quite detrimental in the dryers, which have been designed as compact in the other respects. Further, owing to its location, the capacitor is subject to contamination and to resulting sparking.

Another essential deficiency of said equipment is the increase in voltage produced by the standing waves formed by the AC-voltage as the distance from the current supply point becomes larger. As increased voltage again causes an increase in the power transfer, whereby a different energy is transferred from the roll to the product to be dried depending on the distance of the transfer point from the current supply point. In connection with the description of this prior-art construction, no action has been suggested for attenuation of said increase in voltage, which means that, in the case of veneer drying application, a usable roll length becomes, at the maximum, about 1 m when a supply voltage of 13 MHz is used. With a higher frequency, 27 MHz, the usable length is even shorter, being approximately 0.5 m.

According to the present invention, an essential improvement has been achieved in respect of the above problem of power transfer face, and so also in respect of possibilities to compensate for the voltage increase, by means of a constructional solution, which is characterized in that, in the transfer capacitors of each roll, the roll mantle is arranged as the counter-electrode of the electrode connected to the current source. In such a case, the electrode connected to the current source can be fitted either outside the roll or inside the roll. As regards the embodiment of an electrode placed outside the roll, there are different alternatives, whereas, regarding an inside electrode, owing to restrictions of space, a substantially rod-like electrode can be concerned.

As an electrode placed outside the roll, advantageously a trough extending over a substantial proportion of the length of the roll is used, which surrounds a roll-mantle segment at a distance of a certain, constant gap. Instead of a trough, it is also possible to use a rod electrode parallel to the roll, or a number of rod electrodes placed side by side. As an outside electrode, it is also possible to use a plate member placed tangentially to the roll at a distance of a certain gap. In this connection, besides a solid plate, a plate is also understood as meaning a wire fabric as well as a perforated plate.

Figure 2:
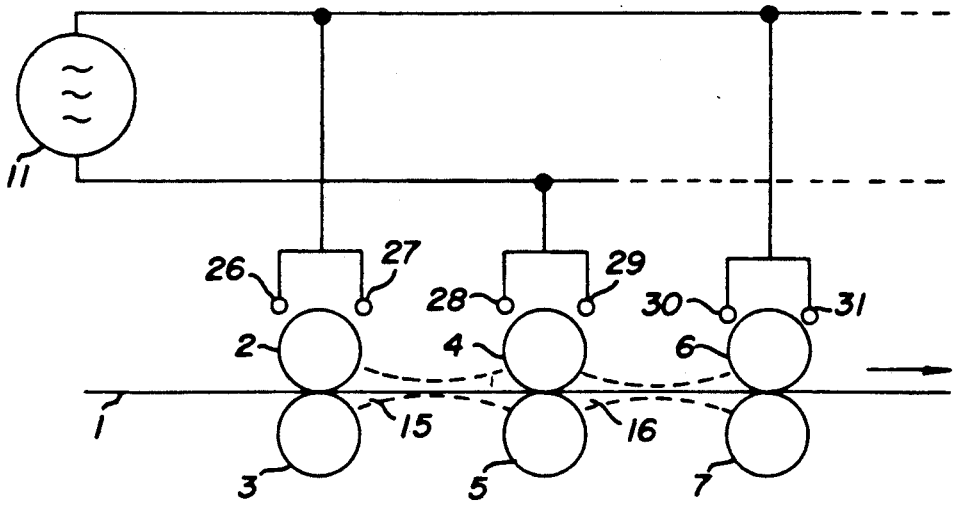
Figure 3:
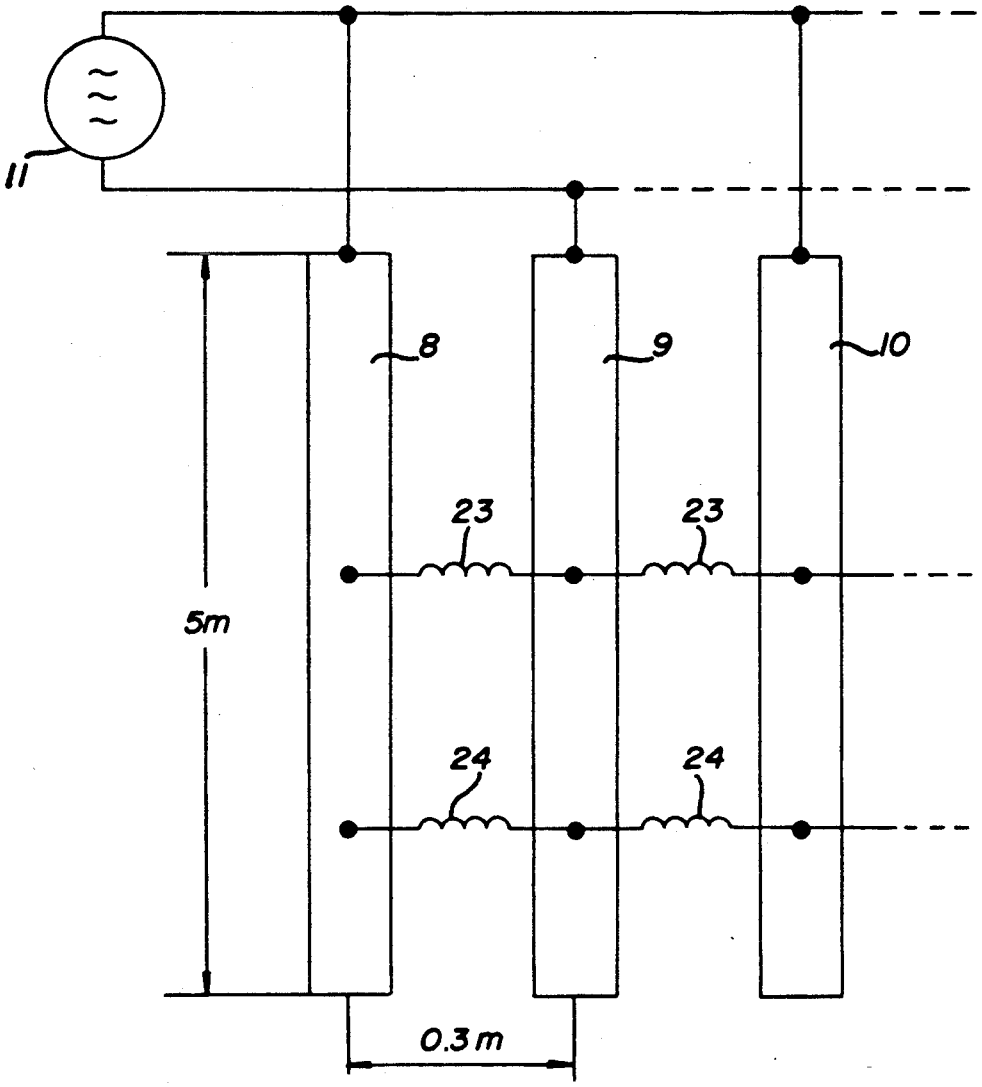
Figure 4:
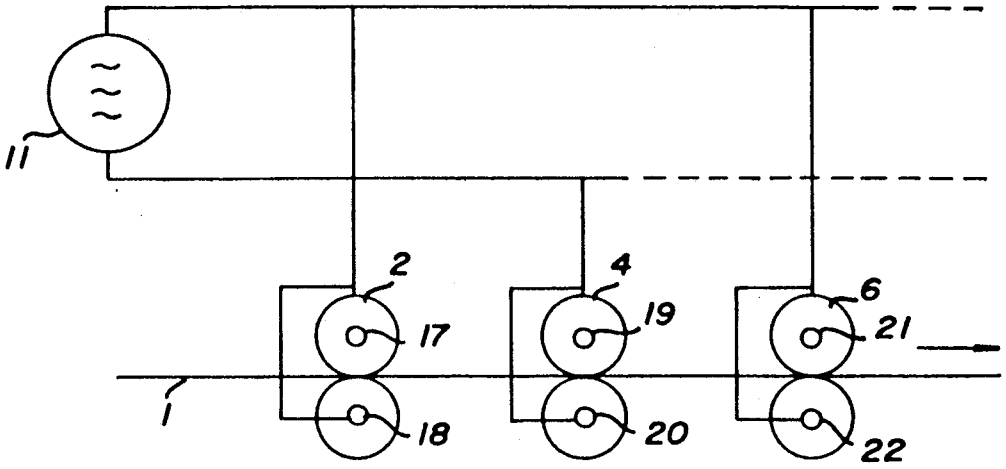
Figure 5:
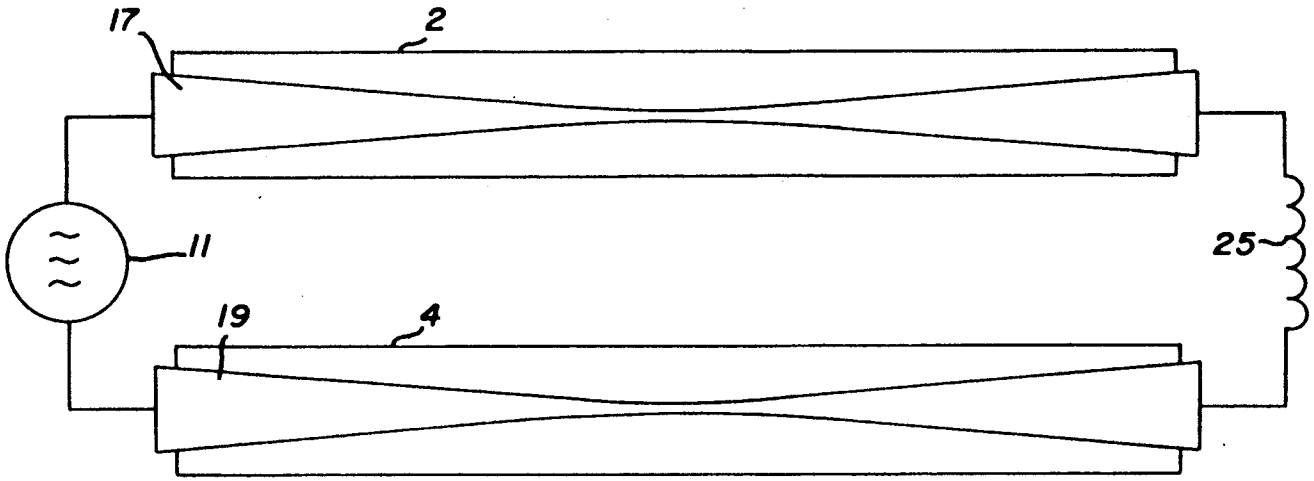

The invention will be described with the aid of the accompanying schematical exemplifying drawing, wherein FIG. 1 shows one embodiment of the invention, wherein a trough electrode placed outside the roll is used, FIG. 2 shows a second embodiment of the invention, wherein a rod electrode placed outside the roll is used, FIG. 3 shows an embodiment in accordance with FIG. 1 as viewed from above, FIG. 4 shows a third embodiment of the invention, wherein an electrode placed inside the roll is used, and FIG. 5 shows a detail of the construction shown in FIG. 4 for the purpose of illustrating the variation in the cross-sectional shape of the electrode.

FIGS. 1 and 2 in the drawing show a part of a drying equipment for plywood veneer 1 that operates continuously, wherein the veneer is passed through nips formed by pairs of rolls 2,3; 4,5 and 6,7 placed on after the other. In the embodiment shown, the upper rolls in the pairs of rolls are connected to the high-frequency generator 11, alternatingly to different poles of the generator. Thereby the high-frequency AC-voltage passed to the rolls forms electromagnetic fields 15 and 16 between adjoining pairs of rolls, which magnetic fields are, owing to differences in the dielectricity of air and of veneer, respectively, mainly applied to the veneer. In the veneer, this electromagnetic field is applied to its moist portions because of differences in dielectricity. The field produces heating of the water, and thereby its vaporization.

In view of passing the high-frequency energy to the rolls 2, 4 and 6, in the solution in accordance with FIG. 1, part of the upper portions of the rolls are surrounded by troughs 8, 9 and 10 placed at a distance of the air gaps 12, 13 and 14 and made of an electrically conductive, non-ferritic material. The mantle of each roll 2, 4 and 6, which is made of an electrically conductive, non-ferritic material, acts as the other electrode of the transfer capacitor consisting of a trough and a roll.

In the dimensioning of the troughs 8, 9 and 10 is relation to the rolls 2, 4 and 6, consideration should be given firstly to the formation of an adequate power transfer face. The power transfer face can be affected by means of the extension of the troughs around the rolls as well as by means of the extension of the troughs over the length of the rolls. The extension over the length of the rolls has also its effect on the distribution of the. power transfer across the length of the roll, which matter will be returned to later. If the dimensioning of the troughs is examined from the point of view of an adequate transfer of power alone, in the above borderline case of a "trough", wherein the outside electrode of the transfer capacitor consists of a plate tangential to the roll at the distance of a gap, this plate must extend over a substantial proportion of the length of the roll, e.g. over about ⅔ of the length of the roll.

In principle, an equipment in accordance with FIG. 1 might also be carried out so that the trough that forms the delivering face of a transfer capacitor surrounds the lower roll in a pair of rolls, or alternatively both rolls in a pair of rolls, but in respect of a trough that is open upwards the problems of contamination would, of course, be more difficult than in the embodiment shown in FIG. 1.

Instead of a trough electrode for a capacitor, it is also possible to use a rod electrode solution in accordance with FIG. 2. The electrode rods 26 to 31 pass as parallel to the rolls at the distance of a certain air gap from the roll mantles. In the embodiment shown, there are two rods per roll, it having been noticed that this construction provides substantially the same power transfer as a trough construction as shown in FIG. 1 does. The number of rod electrodes per roll may also be higher, but a single-rod solution is also usable.

The advantages of said outside rod electrode, as compared with a trough solution, include absence of sharp edges and, thereby, low number of points susceptible of sparking. By means of a hollow rod, it is also possible to provide robust outside electrode constructions of low weight even for long rolls. Nor is the problem of contamination a restrictive factor if it is desirable to install an electrode underneath the roll.

In FIG. 4, an equipment is shown that is in the other respects similar to those shown in FIGS. 1 and 2, but in each transfer capacitor, the electrode connected to the source of current is formed as a rod electrode 17, 18, 19, 20, 21 and 22, which are fitted inside the rolls. In this embodiment, the supply of energy could be similar to that shown in FIG. 1 in the respect that the supply were arranged to one roll only in a pair of rolls. In this case, it could be either one of the rolls, for example alternatingly the upper roll and the lower roll, respectively, because problems of contamination do not occur.

Differing from the embodiments discussed above, within the scope of the invention, instead of pairs of rolls, the system of rolls may also be accomplished as comprising one roll only at each point, for example, just as a lower roll that carries the veneer mat.

The embodiments shown in FIGS. 1 and 2, wherein the electrodes connected to the source of current are placed outside the roll, provide quite an advantageous possibility of variation in comparison to prior-art drying equipments. Out of reasons of purposefulness, the energy is supplied to each transfer capacitor substantially from either end of the roll. However, this energy has a tendency to be increased relatively rapidly as the transfer distance becomes longer, because of formation of standing waves dependent on the frequency. In such a case, from the other end of the roll a higher amount of energy is transferred than from the end to which the supply cable is connected. True enough, it is possible to halve the problem by providing supply of energy at both ends of the roll, but in spite of this the problem is still significant in the case of wider drying equipments, in which the roll length may be, for example, about 5 m.

In an equipment as shown in FIGS. 1 or 2, if the supply of AC-voltage were arranged from one end of a roll only, in the drying of veneer, such a situation of operation is fully possible wherein a supply voltage of 5 kV is increased along with the roll length (dryer width) from the supply point as follows: 1 m, about 23 kV; 2 m, about 42 kV;3 m, about 58 kV; 4 m about 66 kV; 5 m, about 70 kV.

The problem of voltage increase can, however, be solved by inductively interconnecting the adjoining transfer capacitors of opposite polarity in respect of the outside electrode. In the example case mentioned above, the interconnecting can be carried out, e.g., at the points about 2 m and 4 m from the current supply point, in which case the supply voltage of 5 kV rises between the connecting coils, at the maximum, by about 0.2 kV. In FIG. 3, said connection is shown as carried out by means of the coils 23 and 24. A corresponding connection can be carried out in the embodiment shown in FIG. 2 in respect of the outside rod electrodes 26,27; 28,29; 30,31.

One possible embodiment of supply of energy from outside the roll mantle with reasonably good control of the problem of voltage increase is sectional arrangement of the electrode of the transfer capacitor that is connected to the current source over the length of the roll, e.g., as short troughs or rods. In such a case, the supply of power might be accomplished by means of a relatively short electrode fitted in the area of each end of the roll, the length of such an electrode being, e.g., about 1/6 to 1/5 of the roll length. In addition to this, a corresponding electrode unit ought to be placed in the middle area of the roll, said unit being connected inductively with the corresponding electrode units of the adjoining rolls.

A possible alternative embodiment would be separate supply of current to each electrode section, but such a construction is difficult to carry out in practice.

The effect of a voltage increase on the power that is transferred at different points on the length of the roll can also be regulated by acting upon the air gap in the capacitor, but congested structures impose their limitations on this alternative.

In the embodiment shown in FIG. 4, it is also possible to compensate for the voltage increase. One possibility of compensation is the supply of current to both ends of a rod, referred to above. This solution, however, makes the equipment more complicated. Another mode of compensation is to connect an electrode placed inside the roll, for example the rod 17, with the rod electrode 19 in the adjoining roll at the opposite end, in relation to the current-supply end, inductively by means of a coil 25. However, the improvement obtained by means of this action does not extend over the entire length of the roll, but the voltage rises in the middle portion of the roll. This problem can, however, be solved by increasing the air gap in the capacitor in order to counteract the voltage increase, which can be achieved by reducing the cross-sectional area of the capacitor rod placed inside the roll, as is shown schematically in FIG. 5. The cross-section/length interdependence of a rod electrode can be determined in consideration of the particular properties of the various objects of use. In view of equalization of the voltage, a rod section that varies continuously is preferable, but, in practice, stepwise variations also provide a reasonably good result.

With the roll length of 5 m mentioned in the above embodiment, the voltage would rise quite steeply if the current were supplied from one end only and if the air gap were not altered in accordance with the length of the roll. For example, in an embodiment, if the voltage at the feed point were 1.5 kV, towards the final end it would rise as follows: 0 m, 1.5 kV; 1 m, 4.3 kV; 2 m, 6.6 kV; 3 m, 8.5 kV; 4 m, 9.5 kV; 5 m, 10 kV, which increase can be considered as excessive. By connecting a coil to the opposite end, the voltage distribution can be changed in this particular case, e.g., as follows: 0 m, 1.5 kV; 1 m, 1.8 kV; 2 m, 1.95 kV; 3 m, 1.95 kV; 4 m, 1.8 kV; 5 m, 1.5 kV. In such a case, the voltage variation within the entire distance would be within the limits of ±0.24 kV (±14%), which can already be considered reasonable in some applications. However, an even better result is obtained with a method of the invention wherein the impedance of the roll is changed in the longitudinal direction of the roll by varying the diameter of the capacitor rod (variation of air gap) so that it is smallest at the maximum point of the voltage and largest at the minimum voltage point, i.e., in the latter case, at the ends of the roll. Thereby, if, for example, ±5% is permitted as voltage variation, the following voltage distribution were obtained: 0 m, 1.5 kV; 1 m, 1.58 kV; 2 m, 1.68 kV; 3 m, 1.68 kV; 4 m 1.58 kV; 5 m 1.5 kV.

We claim:

1. Equipment for heating of a dielectric web or sheet material or for lowering moisture content of said dielectric web or sheet material by means of high-frequency heating, said equipment comprising:

at least two rotating rolls for supporting a travelling web, said rolls adjacently and parallelly located essentially equally spaced along a travelling direction of the web, each roll having a roll mantle; and a high frequency energy source having opposite polarities at contacts thereof, each roll connected to an opposite polarity contact than the adjacent roll, a connection between one roll and a respective contact effected contactless by means of a capacitor having a first capacitor plate connected to the roll, said roll mantle arranged to form said first capacitor plate, and a second capacitor plate connected to the respective contact of the high-frequency power source, the second capacitor plate is arranged at a predetermined capacitor gap distance along the roll mantle.

2. Equipment as claimed in claim 1, wherein the second capacitor plate is placed outside the roll mantle.

3. Equipment as claimed in claim 2, wherein the second capacitor plate is shaped as trough unit extending over a substantial proportion of a roll length and surrounding a roll mantle segment at the capacitor gap distance.

4. Equipment as claimed in claim 2, wherein the second capacitor plate is formed as a rod electrode, which passes parallel to the roll mantle, at said capacitor gap distance from the mantle, and extends over a substantial proportion of a roll length.

5. Equipment as claimed in claim 3, wherein a number of rod electrodes is 1 to 5, preferably 2 per roll.

6. Equipment as claimed in any of the preceding claims 2 to 5, wherein the second capacitor plate of each roll is connected inductively with the respective capacitor plate of any adjacent roll.

7. Equipment as claimed in any of the preceding claims 2 to 5, wherein second capacitor plate is formed of sections intermittently placed in a longitudinal direction of the roll.

8. Equipment as claimed in claim 1, wherein the second capacitor formed as a rod electrode is placed inside the roll and extends over a substantial proportion of a roll length.

9. Equipment as claimed in claim 8, wherein a diameter of a rod electrode is different at different points on a length of the rod electrode in view of varying the capacitor gap distance.

10. Equipment as claimed in any of the preceding claims 1 or 2 to 5, wherein current from the high-frequency energy source supplied to the second capacitor plate is applied at both ends of the roll.

11. Equipment as claimed in any of the preceding claims 1 or 2 to 5, wherein current from the high-frequency energy source supplied to the second capacitor plate is applied at both ends of the roll.

12. Equipment as claimed in any of the preceding claims 2 to 5, wherein current from the high-frequency energy source supplied to the second capacitor plate is additionally applied at one or several points between ends of the roll.

13. Equipment as claimed in any of the preceding claims 1 or 2 to 5, wherein each of the rolls in spaced locations are formed as a pair of rolls forming a passing trough nip for the material web to be heated.

* * * * *